US006752279B1

(12) United States Patent
Dwyer

(10) Patent No.: US 6,752,279 B1
(45) Date of Patent: Jun. 22, 2004

(54) DEVICE FOR ATTACHING AT LEAST ONE FLOWER POT TO A TREE TRUNK

(76) Inventor: Timothy P. Dwyer, 38-35 215th Pl., Bayside, NY (US) 11361

( * ) Notice: Subject to any disclaimer, the term of this patent is extended or adjusted under 35 U.S.C. 154(b) by 0 days.

(21) Appl. No.: 10/284,521

(22) Filed: Oct. 30, 2002

(51) Int. Cl.[7] ..... A47F 5/08; A47G 7/02

(52) U.S. Cl. ..... 211/107; 211/112; 211/88.03; 211/85.23; 211/205; 248/27.8; 47/67

(58) Field of Search ..... 211/85.23, 107, 211/112, 88.03, 196, 205; 40/124.01, 642.02, 645; 47/67, 39, 40, 44–47; 248/27.8, 218.4, 219.4, 219.3, 230.8, 339, 317, 302–305, 309.1, 312.1, 315

(56) References Cited

U.S. PATENT DOCUMENTS

| | | | | | |
|---|---|---|---|---|---|
| 1,045,583 | A | * | 11/1912 | Mills | 211/85.6 |
| 2,774,562 | A | * | 12/1956 | Henry | 248/125.1 |
| 3,097,079 | A | * | 7/1963 | Todd et al. | 248/27.8 |
| 3,194,403 | A | * | 7/1965 | Van Horn, Jr. | 211/78 |
| D210,302 | S | | 2/1968 | Lansford | |
| 3,642,145 | A | * | 2/1972 | Shelton | 211/78 |
| 4,083,457 | A | | 4/1978 | Dromboski | |
| 4,289,246 | A | * | 9/1981 | Scott | 211/205 |
| 4,623,113 | A | * | 11/1986 | Studebaker | 248/311.2 |
| 4,757,641 | A | * | 7/1988 | Penrod | 47/39 |
| 4,865,283 | A | * | 9/1989 | Parker | 248/159 |
| 5,235,780 | A | * | 8/1993 | Colbert | 47/41.12 |
| 5,259,141 | A | | 11/1993 | D'Alessandro | |
| 5,292,014 | A | | 3/1994 | Lelong | |
| 5,366,192 | A | * | 11/1994 | Carroll | 248/152 |
| 5,458,243 | A | * | 10/1995 | McBride | 206/503 |
| D369,123 | S | | 4/1996 | D'Alessandro | |
| 6,086,031 | A | * | 7/2000 | Renfro | 248/218.4 |
| 6,123,206 | A | * | 9/2000 | Zaremba | 211/107 |
| D450,624 | S | | 11/2001 | Stern | |
| 6,595,377 | B1 | * | 7/2003 | Hetu | 211/85.23 |
| 2002/0195529 | A1 | * | 12/2002 | Vanech | 248/218.4 |

FOREIGN PATENT DOCUMENTS

| | | | | |
|---|---|---|---|---|
| DE | 3431438 | A1 | * 2/1986 | A47G/7/02 |

* cited by examiner

*Primary Examiner*—Jennifer E. Novosad
(74) *Attorney, Agent, or Firm*—Richard L. Miller

(57) ABSTRACT

A device for attaching at least one flower pot to a tree trunk. At least one flower pot holder holds the at least one flower pot, respectively. A strap engages the at least one flower pot holder and attaches the at least one flower pot holder to the tree trunk. A skirt is an elongated sheet of material that engages the at least one flower pot holder and wraps around the tree trunk. Each flower pot holder is a continuous rod bent into a vertical portion and a horizontal portion. The vertical portion is U-shaped and abuts against the tree trunk. The horizontal portion has a neck that extends perpendicularly outwardly and continuously from the vertical portion and a head that is ring-shaped and extends coplanarly outwardly and continuously from, and is wider than, the neck and holds one flower pot.

17 Claims, 2 Drawing Sheets

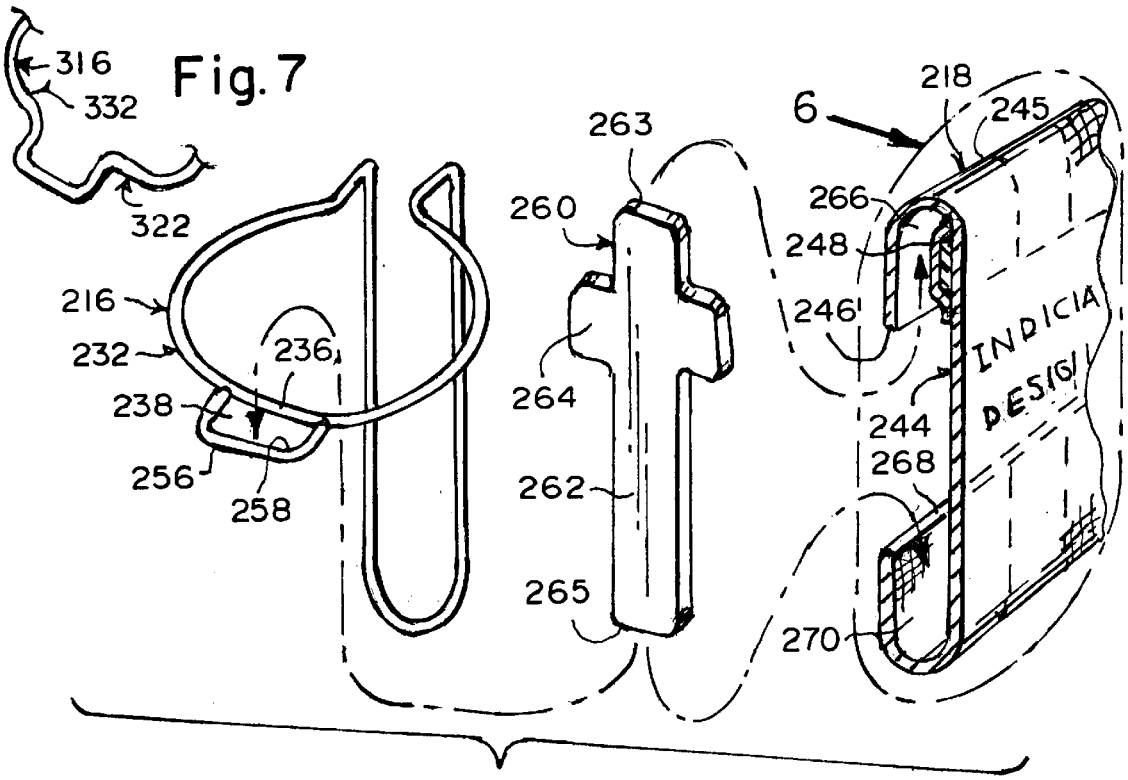
Fig. 7
Fig. 5
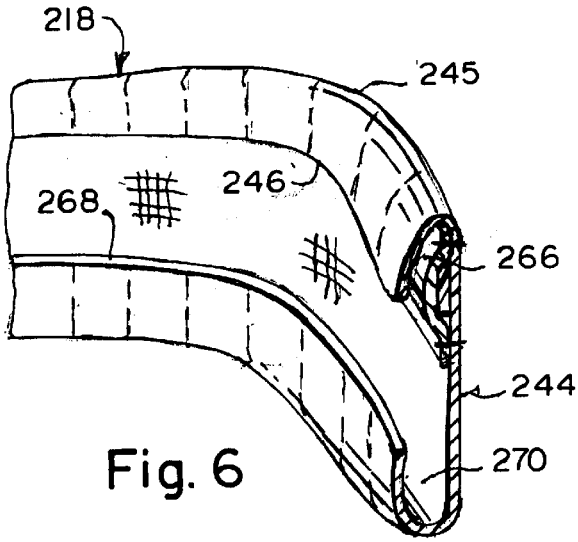
Fig. 6
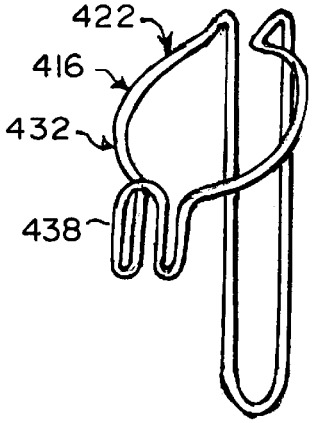
Fig. 8

DEVICE FOR ATTACHING AT LEAST ONE FLOWER POT TO A TREE TRUNK

BACKGROUND OF THE INVENTION

1. Field of the Invention

The present invention relates to a device for attaching at least one flower pot. More particularly, the present invention relates to a device for attaching at least one flower pot to a tree trunk.

2. Description of the Prior Art

Numerous innovations for devices for attaching flower pots to a tree trunk have been provided in the prior art that will be described. Even though these innovations may be suitable for the specific individual purposes to which they address, however, they differ from the present invention.

A FIRST EXAMPLE U.S. Pat. No. Des. 210,302 to Lansford teaches the ornamental design for a planter.

A SECOND EXAMPLE U.S. Pat. No. 4,083,457 to Dromboski teaches a bracket arrangement adapted to support a plurality of flowerpots or similar articles. The bracket comprises an integral member fabricated from a flexible material having a horizontal central portion located between two arcuate end portions, each end portion terminating in an opened circular loop with a traverse arm extending from said central portion, said central portion having an extending projection relatively centrally located thereon and at least two apertures located on said central portion on either side of said projection to enable the coupling of an additional bracket of a mirror-image configuration to said bracket form a composite bracket configuration having a pole accommodating coupling means formed by the coaction of said extending projections.

A THIRD EXAMPLE U.S. Pat. No. 5,259,141 to D'Alessandro teaches a planter for supporting a plurality of plant pots around the trunk of a tree comprising a plurality of identical, flat segments, each segment forming the arc of a circle having an opening in the middle to support a flower pot. A pair of arcuate slots are located on opposite sides of the opening, the segments overlapping each other with the arcuate slots on overlapping segments being aligned with each other and surround the trunk. A bolt extends through each pair of aligned slots held together by a wind nut which are locked together after sliding said overlapping segments with respect to each other to closely fit the outline of the trunk. The segments can be designed to accommodate a pole with a rectangular cross section.

A FOURTH EXAMPLE U.S. Pat. No. 5,292,014 to Lelong teaches a tensile support device comprising a pair of rigid, elongated members which are horizontally disposed and attached closely together at their outer ends and held widely spaced apart by a cable or strap at their inner ends which rest against a supporting surface, such as a wall, a tree, a pole, or a plurality of balcony posts. A tensional support cable is fastened at its lower end to the outer ends of the members or to the connection between the outer ends of the members and at its upper end to the supporting surface, or to a window sill by using an auxiliary bracket, at a point substantially above the inner ends, whereby a compressive force is created along the rigid members when a plant container is hooked over the connection between the outer ends.

A FIFTH EXAMPLE U.S. Pat. No. Des. 369,123 to D'Alessandro teaches the ornamental design for a tree planter.

A SIXTH EXAMPLE U.S. Pat. No. D450,624 S to Stern teaches the ornamental design for a flower holder.

It is apparent that numerous innovations for devices for attaching flower pots to a tree trunk have been provided in the prior art that are to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for attaching at least one flower pot to a tree trunk that avoids the disadvantages of the prior art.

ANOTHER OBJECT of the present invention is to provide a device for attaching at least one flower pot to a tree trunk that is simple and inexpensive to manufacture.

STILL ANOTHER OBJECT of the present invention is to provide a device for attaching at least one flower pot to a tree trunk that is simple to use.

BRIEFLY STATED, STILL YET ANOTHER OBJECT of the present invention is to provide a device for attaching at least one flower pot to a tree trunk. At least one flower pot holder holds the at least one flower pot, respectively. A strap engages the at least one flower pot holder and attaches the at least one flower pot holder to the tree trunk. A skirt is an elongated sheet of material that engages the at least one flower pot holder and wraps around the tree trunk. Each flower pot holder is a continuous rod bent into a vertical portion and a horizontal portion. The vertical portion is U-shaped and abuts against the tree trunk. The horizontal portion has a neck that extends perpendicularly outwardly and continuously from the vertical portion and a head that is ring-shaped and extends coplanarly outwardly and continuously from, and is wider than, the neck and holds one flower pot.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 5 is an exploded diagrammatic perspective view of a second embodiment of the flower pot holder and the skirt of the present invention;

FIG. 6 is a diagrammatic perspective view of the area generally enclosed by the dotted curve identified by arrow 6 in FIG. 5 of the second embodiment of the skirt of the present invention;

FIG. 7 is a fragmented diagrammatic perspective view of a third embodiment of the flower pot holder of the present invention; and FIG. 8 is a fourth embodiment of the flower pot holder of the present invention.

LIST OF REFERENCE NUMERALS UTILIZED IN THE DRAWING

Figure 1:
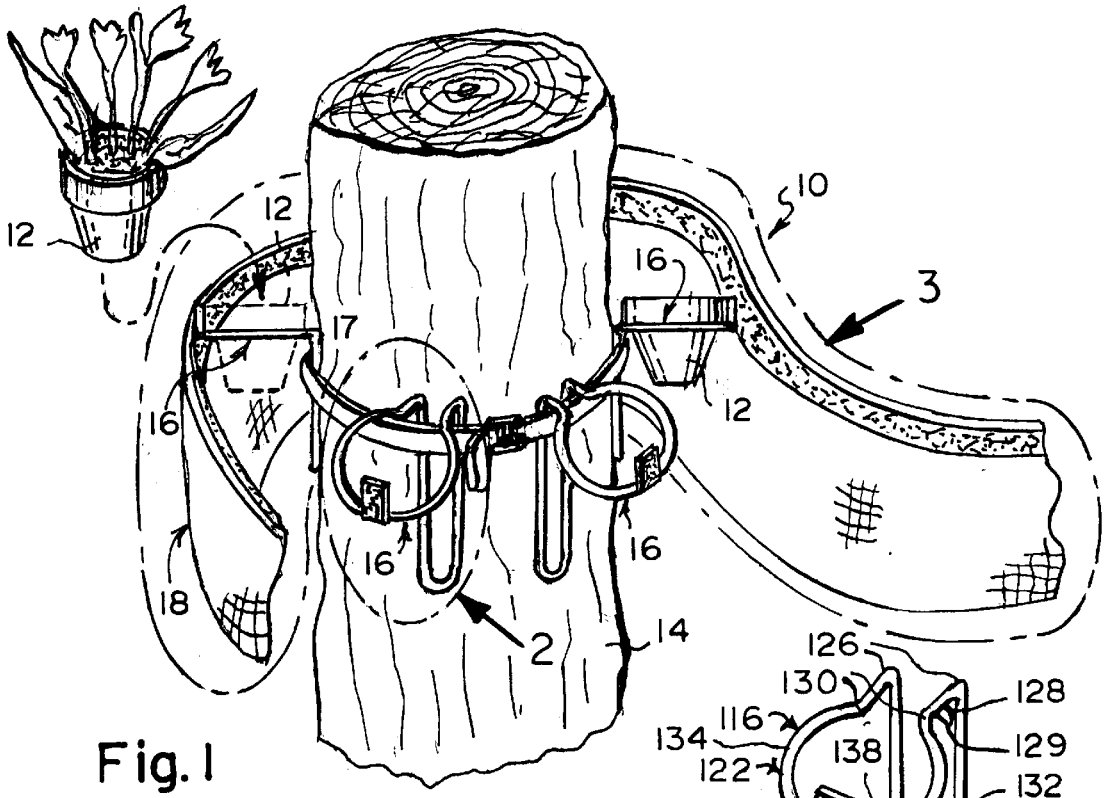
FIG. 1 is a diagrammatic perspective view of present invention in use.
Figure 2:
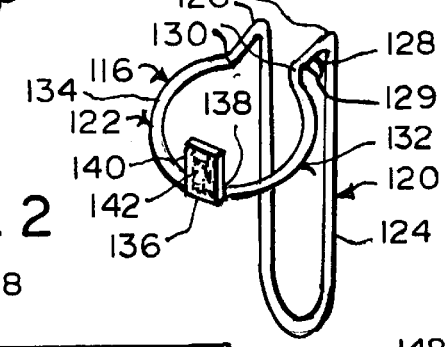
FIG. 2 is an enlarged diagrammatic perspective view of the area generally enclosed by the dotted curve identified by arrow 2 in FIG. 1 of a first embodiment of the flower pot holder of the present invention.
Figure 3:
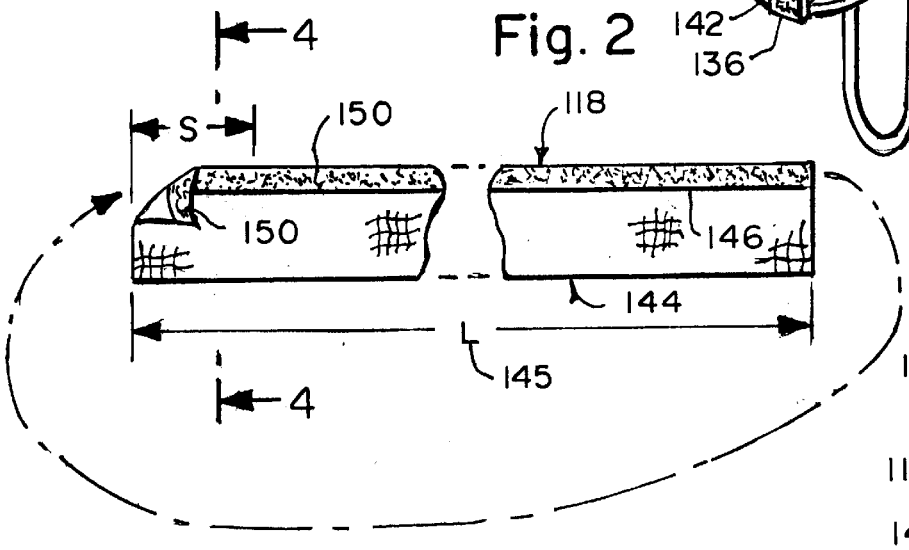
FIG. 3 is an enlarged diagrammatic side elevational view of the area generally enclosed by the dotted curve identified by arrow 3 in FIG. 1 of a first embodiment of the skirt of the present invention.
Figure 4:
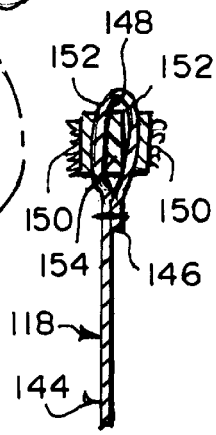
FIG. 4 is an enlarged cross sectional view taken on line 4—4 in FIG. 3.

10 device of present invention for attaching at least one flower pot 12 to tree trunk 14
12 at least one flower pot
14 tree trunk
16 at least one flower pot holder for holding at least one flower pot 12, respectively
17 strap for attaching at least one flower pot holder 16 to tree trunk 14
18 skirt for wrapping around tree trunk 14

First Embodiment

116 at least one flower pot holder for holding at least one flower pot 12, respectively
118 skirt
120 vertical portion of each flower pot holder of at least one flower pot holder 116 for abutting against tree trunk 14
122 horizontal portion of each flower pot holder of at least one flower pot holder 116 for holding one flower pot of at least one flower pot 12
124 rod of each flower pot holder of at least one flower pot holder 116
126 uppermost ends of vertical portion 120 of each flower pot holder of at least one flower pot holder 116
128 neck of horizontal portion 122 of each flower pot holder of at least one flower pot holder 116
129 pair of rods of neck 128 of horizontal portion 122 of each flower pot holder of at least one flower pot holder 116
130 pair of forwardmost ends of pair of rods 129 of neck 128 of horizontal portion 122 of each flower pot holder of at least one flower pot holder 116
132 head of horizontal portion 122 of each flower pot holder of at least one flower pot holder 116
134 ring of head 132 of horizontal portion 122 of each flower pot holder of at least one flower pot holder 116 for holding one flower pot of at least one flower pot 12
136 outermost area of ring 134 of head 132 of horizontal portion 122 of each flower pot holder of at least one flower pot holder 116
138 auxiliary portion of outermost area 136 of ring 134 of head 132 of horizontal portion 122 of each flower pot holder of at least one flower pot holder 116
140 tab of auxiliary portion 138 of outermost area 136 of ring 134 of head 132 of horizontal portion 122 of each flower pot holder of at least one flower pot holder 116
142 portion of hook and loop fasteners of auxiliary portion 138 of outermost area 136 of ring 134 of head 132 of horizontal portion 122 of each flower pot holder of at least one flower pot holder 116
144 elongated sheet of material of skirt 118
145 length of elongated sheet of material 144 of skirt 118
146 uppermost edge of length 145 of elongated sheet of material 144 of skirt 118
148 axial loop formed by uppermost edge 146 of length 145 of elongated sheet of material 144 of skirt 118
150 mating portions of hook and loop fasteners of skirt 118
152 opposite faces of uppermost edge 146 of length 145 of elongated sheet of material 144 of skirt 118 forming axial loop 148
154 insert of skirt 118

Second Embodiment

216 at least one flower pot holder
218 skirt
232 head of each flower pot holder of at least one flower pot holder 216
238 auxiliary portion of head 232 of each flower pot holder of at least one flower pot holder 216
244 elongated sheet of material of skirt 218
245 length of elongated sheet of material 244 of skirt 218
246 uppermost edge of length 245 of elongated sheet of material 244 of skirt 218
256 rod of auxiliary portion 238 of head 232 of each flower pot holder of at least one flower pot holder 216
258 loop of rod 256 of auxiliary portion 238 of head 232 of each flower pot holder of at least one flower pot holder 216
260 cross of each flower pot holder of at least one flower pot holder 216
262 upright portion of cross 260 of each flower pot holder of at least one flower pot holder 216
263 uppermost end of upright portion 262 of cross 260 of each flower pot holder of at least one flower pot holder 216
265 lowermost end of upright portion 262 of cross 260 of each flower pot holder of at least one flower pot holder 216
264 transverse portion of cross 260 of each flower pot holder of at least one flower pot holder 216
266 upper pocket formed by uppermost edge 246 of length 245 of elongated sheet of material 244 of skirt 218
268 lowermost edge of elongated sheet of material 244 of shirt 218
270 lower pocket formed by lowermost edge 268 of elongated sheet of material 244 of skirt 218

Third Embodiment

316 at least one flower pot holder
332 head of horizontal portion 322 of each flower pot holder of at least one flower pot holder 316

Fourth Embodiment

416 at one flower pot holder
438 auxiliary portion of head 432 of horizontal portion 422 of each flower pot holder of at least one flower pot holder 416

DETAILED DESCRIPTION OF THE PREFERRED EMBODIMENT

Referring now to the figures, in which like numerals indicate like parts, and particularly to FIG. 1, the device of the present invention is shown generally at 10 for attaching at least one flower pot 12 to a tree trunk 14.

The device 10 comprises at least one flower pot holder 16, a strap 17, and a skirt 18. The at least one flower pot holder 16 is for holding the at least one flower pot 12, respectively. The strap 17 engages the at least one flower pot holder 16 and is for attaching the at least one flower pot holder 16 to the tree trunk 14. The skirt 18 engages the at least one flower pot holder 16 and is for wrapping around the tree trunk 14.

The specific configuration of a first embodiment of the at least one flower pot holder 116 and the skirt 118 associated therewith can best be seen in FIGS. 1–4, and as such, will be discussed with reference thereto.

Each flower pot holder 116 is a rod 124. The rod 124 is slender, elongated, continuous, and bent into a vertical portion 120 and a horizontal portion 122.

The vertical portion 120 of each flower pot holder 116 is U-shaped, has a pair of uppermost ends 126, and is for abutting against the tree trunk 14.

The horizontal portion 122 of each flower pot holder 116 has a neck 128. The neck 128 of the horizontal portion 122 of each flower pot holder 116 comprises a pair of rods 129 that are continuations of the vertical portion 120 and which extend perpendicularly outwardly from the pair of uppermost ends 126 of the vertical portion 120 of an associated flower pot holder 122, respectively, to a pair of forwardmost ends 130.

The horizontal portion 122 of each flower pot holder 116 further has a head 132. The head 132 of the horizontal portion 122 of each flower pot holder 116 comprises a ring 134. The ring 134 of the head 132 is a continuation of, and is wider than, the neck 128, extends coplanarly outwardly from the pair of forwardmost end 130 of the neck 128 of an associated flower pot holder 122, respectively, has an outermost area 136, and is for holding one flower pot 12.

The outermost area 136 of the head 132 of each horizontal portion 122 of each flower pot holder 116 has an auxiliary portion 138 thereat.

The auxiliary portion 138 of the outermost area 136 of the head 132 has a tab 140 and a portion of hook and loop fasteners 142. The tab 140 extends vertically upwardly from the auxiliary portion 138, and the portion of hook and loop fasteners 142 is affixed to the tab 140.

The skirt 118 is an elongated sheet of material 144. The elongated sheet of material 144 has a length 145 with an uppermost edge 146.

The uppermost edge 146 of the length 145 of the elongated sheet of material 144 is folded down upon itself, and affixed thereat so as to from an axial loop 148.

The skirt 118 further has mating portions of hook and loop fasteners 150. The mating portions of hook and loop fasteners 150 of the skirt 118 are on opposite faces 152 thereof that form the axial loop 148 of the elongated sheet of material 144.

One portion of the mating portions of hook and loop fasteners 150 engages with the hook and loop fasteners 142 affixed to the tab 140 so as to hold the at least one flower pot holder 116, and to the other portion of the mating portions of hook and loop fasteners 150 once wrapped around the tree trunk 14, and in doing so, holds the at least one flower pot 116 against the tree trunk 14.

The skirt 118 further has an insert 154. The insert 154 is flexible and extends axially through the axial loop 148 of the skirt 118.

The specific configuration of a second embodiment of the at least one flower pot holder 216 and the skirt 218 associated therewith can best be seen in FIGS. 5 and 6, and as such, will be discussed with reference thereto.

The one flower pot holder 216 is similar to the one flower pot holder 116, except:

1. The auxiliary portion 238 of the head 232 is a rod 256. The rod 256 of the auxiliary portion 238 extends coplanarly outwardly from the outermost area 236 of the head 232, is U-shaped, and forms a loop 258.
2. The at least one flower pot holder 216 further comprises a cross 260, and by definition, has an upright portion 262 with an uppermost end 263 and a lowermost end 265 and a transverse portion 264. The upright portion 262 of the cross 260 extends downwardly in the loop 258 of the auxiliary portion 238, until stopped by the transverse portion 264 of the cross 260.

The skirt 218 is similar to the skirt 118, except:

1. The uppermost edge 246 of the length 245 of the elongated sheet of material 244 is folded down upon itself, but is not affixed thereat, so as to form an upper pocket 266 therealong.
2. The elongated sheet of material 244 of the skirt 218 has a lowermost edge 268. The lowermost edge 268 of the elongated sheet of material 244 of the skirt 218 is folded up upon itself so as to form a lower pocket 270.
3. The upper pocket 266 of the skirt 218 receives the uppermost end 263 of the cross 260.
4. The lower pocket 270 of the skirt 218 receives the lowermost end 265 of the cross 260.

The specific configuration of a third embodiment of the at least one flower pot holder 316 can best be seen in FIG. 7, and as such, will be discussed with reference thereto.

The at one flower pot holder 316 is similar to the one flower pot holder 216, except the auxiliary portion 238 of the head 332 is absent.

The specific configuration of a fourth embodiment of the at least one flower pot holder 416 can best be seen in FIG. 8, and as such, will be discussed with reference thereto.

The at one flower pot holder 416 is similar to the one flower pot holder 316, except:

1. The cross 264 is absent.
2. The auxiliary portion 438 of the head 432 is first bent downwardly then upwardly so as to be received in the upper pocket 266 of the skirt 218.

It will be understood that each of the elements described above, or two or more together, may also find a useful application in other types of constructions differing from the types described above.

While the invention has been illustrated and described as embodied in a device for attaching at least one flower pot to a tree trunk, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for attaching at least one flower pot to a tree trunk, comprising:

a) at least one flower not holder;

b) a strap; and c) a skirt;

wherein said at least one flower pot holder is for holding the at least one flower pot;

wherein said strap engages said at least one flower pot holder;

wherein said strap is for attaching said at least one flower pot holder to the tree trunk;

wherein said skirt engages said at least one flower pot holder; and wherein said skirt is for wrapping around the tree trunk, wherein each flower pot holder is a rod;

wherein said rod is elongated;

wherein said rod is continuous;

wherein said rod has a vertical portion; and wherein said rod has a horizontal portion.

2. The device as defined in claim 1, wherein said vertical portion of each flower pot holder is U-shaped;

wherein said vertical portion of each flower pot holder has a pair of uppermost ends; and wherein said vertical portion of each flower pot holder is for abutting against the tree trunk.

3. The device as defined in claim 2, wherein said horizontal portion of each flower pot holder has a neck;

wherein said neck of said horizontal portion of each flower pot holder comprises a pair of rod portions;

wherein said pair of rod portions of said neck are continuations of said vertical portion; and wherein said pair of rod portions of said neck extend perpendicularly outwardly from said pair of uppermost ends of said vertical portion of an associated flower pot holder, respectively, to a pair of forwardmost ends.

4. The device as defined in claim 3, wherein said horizontal portion of each flower pot holder has a head;

wherein said head of said horizontal portion of each flower pot holder comprises a ring;

wherein said ring of said head is a continuation of said neck;

wherein said ring of said head is wider than said neck;

wherein said ring of said head extends coplanarly outwardly from said pair of forwardmost ends of said neck of an associated flower pot holder, respectively;

wherein said ring of said head has an outermost area, and wherein said ring of said head is for holding one flower pot.

5. The device as defined in claim 4, wherein said outermost area of said head of each horizontal portion of each flower pot holder has an auxiliary portion.

6. The device as defined in claim 5, wherein said auxiliary portion of said outermost area of said head has a tab;

wherein said auxiliary portion of said outermost area of said head has a portion of hook and loop fasteners;

wherein said tab extends vertically upwardly from said auxiliary portion; and wherein said portion of hook and loop fasteners is affixed to said tab.

7. The device as defined in claim 6, wherein said skirt is an elongated sheet of material;

wherein said elongated sheet of material has a length;

wherein said length of said sheet of material has an uppermost edge; and wherein said uppermost edge of said length of said elongated sheet of material is folded down upon itself.

8. The device as defined in claim 7, wherein said uppermost edge of said length of said elongated sheet of material is folded down upon itself and affixed thereat so as to from an axial loop.

9. The device as defined in claim 8, wherein said skirt has mating portions of hook and loop fasteners; and wherein said mating portions of hook and loop fasteners of said skirt are on opposite faces thereof that form said axial loop of said elongated sheet of material.

10. The device as defined in claim 9, wherein one portion of said mating portions of hook and loop fasteners of said skirt engages with said hook and loop fasteners affixed to said tab so as to engage said skirt with said at least one flower pot holder; and wherein said one portion of said mating portions of hook and loop fasteners of said skirt is affixed to the other portion of said mating portions of hook and loop fasteners of said skirt once said skirt is wrapped around the tree trunk.

11. The device as defined in claim 8, wherein said skirt has an insert;

wherein said insert is flexible; and wherein said insert extends axially through said axial loop of said skirt.

12. The device as defined in claim 5, wherein said auxiliary portion of said head is a rod;

wherein said rod of said auxiliary portion extends coplanarly outwardly from said outermost area of said head;

wherein said rod of said auxiliary portion is U-shaped; and wherein said rod of said auxiliary portion forms a loop.

13. The device as defined in claim 12, wherein said at least one flower pot holder comprises a cross;

wherein said cross has an upright portion;

wherein said upright portion of said cross has an uppermost end;

wherein said upright portion of said cross has a lowermost end;

wherein said cross has a transverse portion; and wherein said upright portion of said cross extends downwardly in said loop of said auxiliary portion, until stopped by said transverse portion of said cross.

14. The device as defined in claim 13, wherein said skirt is an elongated sheet of material;

wherein said elongated sheet of material has a length;

wherein said length of said sheet of material has an uppermost edge;

wherein said uppermost edge of said length of said elongated sheet of material is folded down upon itself, but is not affixed thereat, so as to form an upper pocket therealong.

15. The device as defined in claim 14, wherein said elongated sheet of material of said skirt has a lowermost edge; and wherein said lowermost edge of said elongated sheet of material of said skirt is folded up upon itself so as to form a lower pocket.

16. The device as defined in claim 15, wherein said upper pocket of said skirt receives said uppermost end of said cross; and wherein said lower pocket of said skirt receives said lowermost end of said cross.

17. The device as defined in claim 14, wherein said auxiliary portion of said head is first bent downwardly then upwardly so as to be received in said upper pocket of said skirt.

* * * * *